US006601424B2

(12) United States Patent
Bagusche

(10) Patent No.: US 6,601,424 B2
(45) Date of Patent: Aug. 5, 2003

(54) TOOL FOR DEEP ROLLING GROOVES OF CRANKSHAFT JOURNALS OR CRANK PINS

(75) Inventor: Siegfried Bagusche, Erkulenz (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 0 days.

(21) Appl. No.: 09/747,866

(22) Filed: Dec. 22, 2000

(65) Prior Publication Data

US 2002/0020202 A1 Feb. 21, 2002

(30) Foreign Application Priority Data

Aug. 17, 2000 (DE) ..... 100 40 146

(51) Int. Cl.[7] ..... B21D 15/00
(52) U.S. Cl. ..... 72/110
(58) Field of Search ..... 72/107, 110; 29/6.01

(56) References Cited

U.S. PATENT DOCUMENTS 5,806,184 A 9/1998 Lonero et al.
6,253,590 B1 * 7/2001 Lonero et al. ..... 72/110
6,257,037 B1 * 7/2001 Lonero et al. ..... 72/110

FOREIGN PATENT DOCUMENTS

EP 0839607 5/1998

* cited by examiner

*Primary Examiner*—Ed Tolan
(74) *Attorney, Agent, or Firm*—Carlson, Gaskey & Olds

(57) ABSTRACT

A tool is provided having two deep rolling work rollers (2) made of a hard material which, for the deep rolling of grooves in crankshaft journals or crank pins, are arranged at a first mutual distance that corresponds to the specific width of the journals. Each of the work rollers (2) is supported to float in a pocket-shaped recess (14) provided in a cage (4), in accordance with the first distance. The cage (4) consists of a material which, compared to the material of the work rollers (2), has a lower degree of hardness but superior sliding characteristics. The cage (4) is located at the extreme end of the long leg (5) of an L-shaped tool holder (6), and has a second distance (8) to a second cage for support of the same work rollers (2). A minimum of one of the recesses (14) of the second cage is configured in a way to provide the work roller (2), at least in the direction of the first distance, with increased mobility, and in addition, a support surface is provided which engages the outer circumference of the work roller (2).

17 Claims, 2 Drawing Sheets

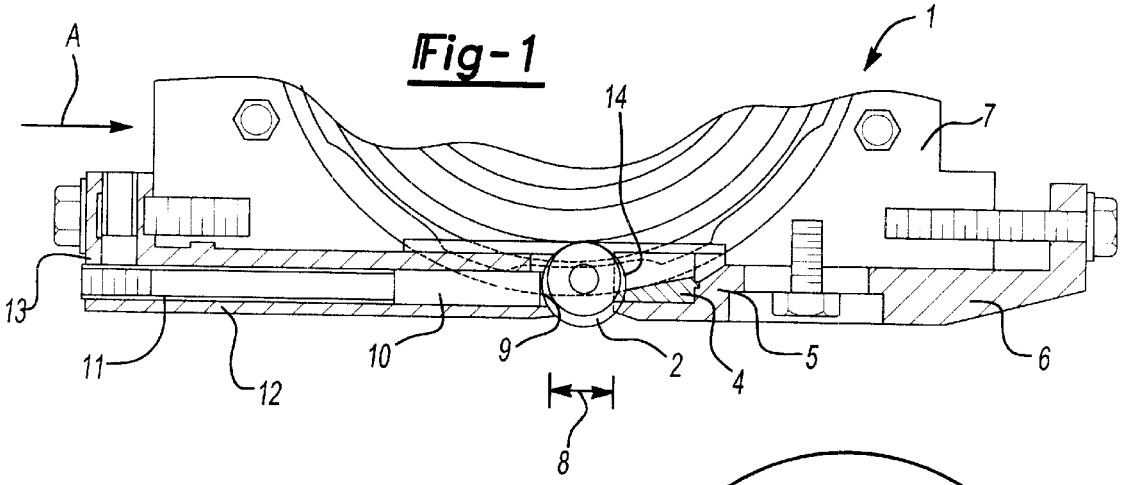
Fig-1
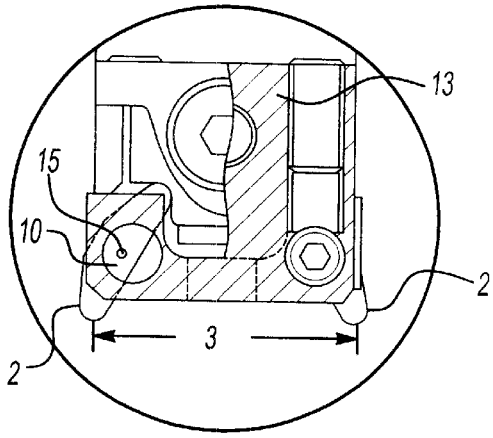
Fig-2
Fig-3
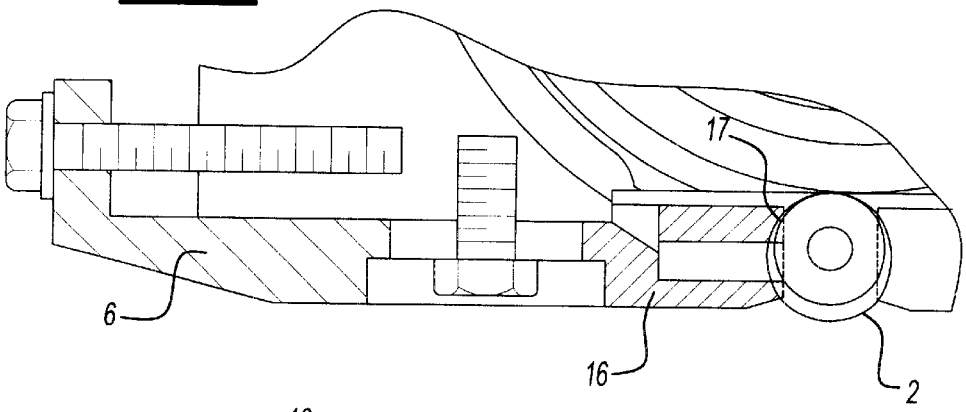
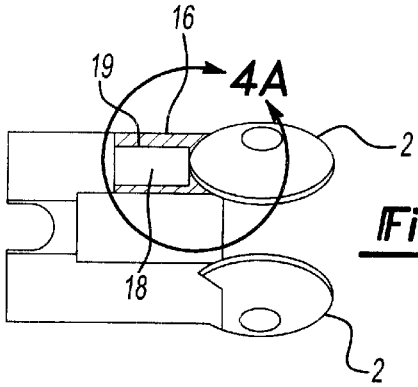
Fig-4

TOOL FOR DEEP ROLLING GROOVES OF CRANKSHAFT JOURNALS OR CRANK PINS

RELATED APPLICATIONS

This application claims priority to German patent application no. 10040146.5; filed Aug. 16, 2000.

BACKGROUND OF THE INVENTION

This invention relates to members of a deep rolling tool used in supporting and locating work rollers.

Prior art deep rolling tools include a housing to which two L-shaped, adjustable roller brackets are attached. On their extreme ends the roller brackets have recesses made to guide cages. These cages are designed for the floating support of the work rollers, in the vertical direction as well as laterally toward the outside. This allows the outside circumferential surface of the work rollers to engage the grooves of crankshaft journals or crank pins for deep rolling of these journals, as described in EP 0 839 607. Work rollers are made of a hard material such as hardened steel, carbide or ceramics.

It is also known that any work to be deep rolled such as crankshafts, is subjected to manufacturing tolerances. In crankshafts, this includes deviations in journal width, misalignment of grooves (eccentricity), deviations in journal spacings and the elongation of the crankshaft itself, all induced by deep rolling. In tools known in the art, the work rollers are supported in their cages in a way allowing them to compensate for these manufacturing tolerances. This capability to compensate is however diminished progressively through their use and the related wear and tear of the tool. With extensive wear a certain "fixation" of the work roller inside the cage is experienced, which results in the cage wearing unilaterally, the guiding faces wearing unilaterally, the deep rolling depths varying, and the work rollers themselves wearing faster until ultimately they develop some chipping in their circumferential surfaces. These conditions will accelerate when the deep rolling force is increased. As a result the service life of the deep rolling tools is reduced.

SUMMARY OF THE INVENTION AND ADVANTAGES

The object of the invention calls for further improvement in the support of deep rolling work rollers in their cages to provide an increased service life for the tools.

The mean selected for attaining this object provides for greater mobility of the work roller in a minimum of one of the two cages in which it floats and, at the same time, for its support on a hard supporting surface. Specifically the support surface is provided by the face of a longish pin fitted in the recess of the cage in which the work roller is guided. It is beneficial to design the pin to be axially adjustable inside the cage, to allow for readjustments with wear. Also, it will suffice to use a pin with a planar face; alternatively, though, the face of the pin may also have a concave depression of moderate depth corresponding to the profile of the work roller.

Another preferred embodiment has the cage divided at its axial center, and a minimum of one of the divided halves flexibly guided in the direction of the width of the journal or crank pin to be rolled. Such mobility is also attained when, e.g., the tool holder is divided over one section of its length, forming two parallel legs, each of which at its extreme end having pocket-shaped recesses for guiding the work roller. A longish pin providing the support surface for the work roller is guided in a minimum of one of the legs. Here again it is intended to arrange for the pin to be axially sliding inside the leg of the L-shaped holder.

The longish pin may have a round, oval or polygonal cross-section. It consists of a hard material, e.g., hardened steel. It is important for the sections of the pin faces that contact the work roller, to have favorable sliding characteristics. To this end the contacting surfaces may be provided with an anti-friction coating.

BRIEF DESCRIPTION OF THE DRAWINGS

In the following the invention will be explained using several embodiments. Using different scales, the following is shown:

FIG. 1 A deep rolling tool in side view;

FIG. 2 an enlarged partial section through the tool of FIG. 1 in direction A;

FIG. 3 a second embodiment of a deep rolling tool;

FIG. 4 a top view of the deep rolling tool according to FIG. 3;

DETAILED DESCRIPTION OF THE PREFERRED EMBODIMENTS

Figure 4A:
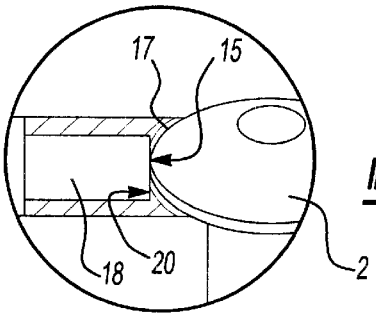
FIG. 4*a* an enlarged partial section through the deep rolling tool of FIG. 4.

The deep rolling tool 1 features two work rollers 2 with floating support having a first distance 3 from one another in a common cage 4. The distance 3 equals the distance between the two related grooves (not shown) of a crankshaft to be processed (not shown).

The cage 4 is guided at the extreme end of the long leg 5 of a first preferably L-shaped tool holder 6 which is connected to the bottom of the tool housing 7, and adjustable.

On the side opposite the cage 4 and in a second distance 8, each of the two work rollers 2 is supported by the face 9 of a hard pin 10. The pins 10 are each guided in axial bores 11 running in parallel inside the long leg 12 of the opposing, second preferably L-shaped tool holder 13. Therefore, instead of a recess 14 in which the work rollers 2 are guided in the cage 4, on the opposite side the work rollers 2 are only offered a point support 15. Consequently, in the direction of the distance 3 the work rollers 2 are provided with greater mobility that is not substantially restricted, even with progressive wear and tear of, e.g., the recesses 14 in the cage 4

In FIG. 3 a cage 16, similar to cage 4, has been carried over for support of the work rollers 2. The recess 17 of the cage 16 is, however, substantially widened compared to the recess 14 of the cage 4. In the cage 16 the work rollers 2 also receive point support from the pins 18 which are located in the bores 19 of the cage 16. The partial section of the cage 16 that, in FIG. 4*a* has been enlarged twice compared to FIG. 4, clearly shows the enlarged recess 17. Here again the work roller 2 receives point support 15 from the face 20 of the pin 18.

Figure 5:
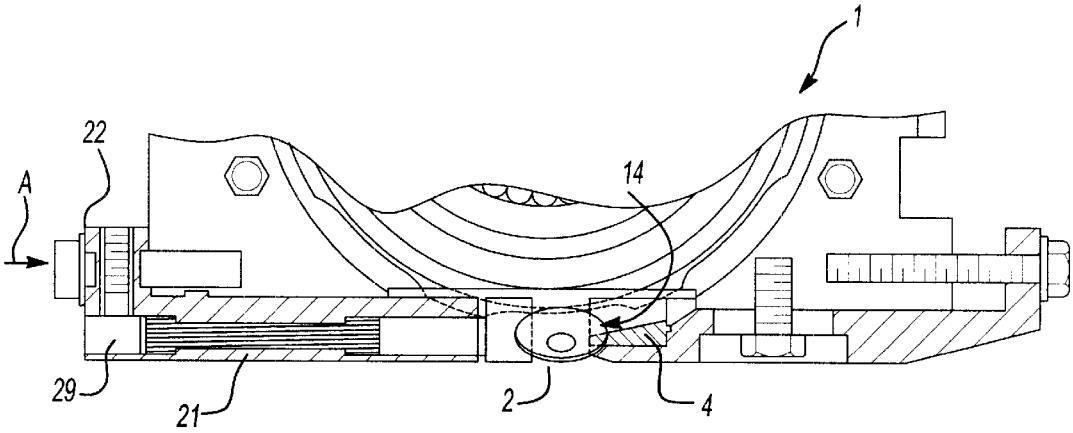
FIG. 5 a third embodiment of a deep rolling tool.
Figure 6:
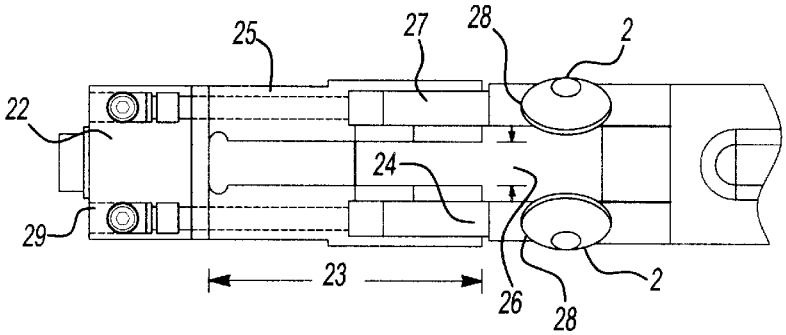
FIG. 6 a top view of the deep rolling tool according to FIG. 5.
Figure 7:
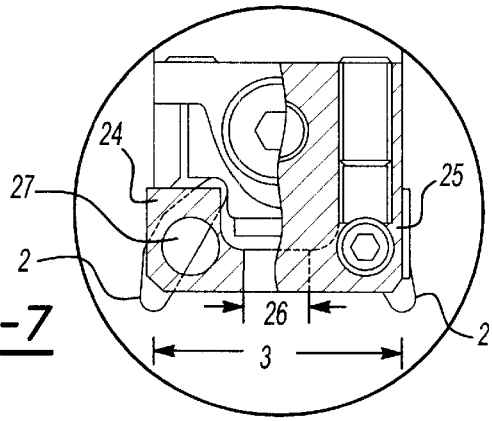
FIG. 7 an enlarged section through the deep rolling tool of FIG. 5.

In FIG. 5 the long leg 21 of a third L-shaped tool holder 22 is divided for a section 23 of its outside length. This results in the forming of 2 legs, 24 and 25, which run in parallel and at a distance 26 from one another. Inside each of the legs, 24, 25, a pin 27 is provided whose outer faces are, e.g., configured as recesses 28 which serve to support the two work rollers 2 against the cage 4. Instead of the recesses 28, the two pins 27 may also have planar faces (not shown). As can be seen, the two legs, 24 and 25, along with the remaining body of the third L-shaped tool holder 22, preferably form the shape of the letter U which, in the direction of the first distance 3, has increased mobility. Using the screws 29 the pins 27 may be adjusted in the axial direction of the two legs, 24 and 25. A readjustment may become necessary as soon as, e.g., the wear and tear of the recesses 14 in the cage 4 has progressed. The pins 27 also consist of a hard material such as hardened steel. Like the cage 4, they may also consist of bronze because, despite wear and tear on their faces 28, due to the U-shape of the third L-shaped tool holder 22, they are capable of compensating for dimensional deviations on the crankshaft regardless of progressing wear and tear.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A deep rolling tool for rolling the grooves on crankshaft journals comprising:

a tool holder;

a first cage supported on said tool holder and including a first recess;

a second cage opposite said first cage and including a second recess;

a work roller interposed between said cages and received by said recesses; and an adjustment pin received in a hole in said second cage, said pin having a face engaging said work roller providing point contact between said pin and said work roller, and said pin moving said work roller towards said first recess.

2. The tool according to claim 1, wherein said first and second cages include third and fourth recesses, respectively, and said tool further includes a second work roller spaced a first distance from said work roller, said second work roller interposed between said cages and received by said third and fourth recesses.

3. The tool according to claim 2, further including a second adjustment pin received in a second hole in said second cage, said second pin having a second face engaging said second work roller providing point contact between said pin and said work roller, and said pin moving said second work roller towards said third recess.

4. The tool according to claim 1, wherein said tool holder is L-shaped.

5. The tool according to claim 1, wherein said tool holder is L-shaped.

6. The tool according to claim 1, further including a clearance between said first recess and said work roller to provide increased lateral mobility.

7. The tool according to claim 1, wherein said pin includes a circular cross-section.

8. The tool according to claim 1, wherein said face includes a low friction coating.

9. The tool according to claim 1, wherein said second cage is defined by a second tool holder opposite said first tool holder.

10. The tool according to claim 1, further including first and second screws respectively received in said first and second holes respectively adjacent to said first and second pins, said screws manipulated to adjust said pins along respective axes.

11. A deep rolling tool for rolling the grooves on crankshaft journals comprising:

a tool holder having first and second spaced apart legs;

first and second cages supported on said first and second legs, respectively, and including first and second recesses, respectively;

a third cage opposite said first and second cages and including third and fourth recesses;

first and second work rollers respectively received by said first and third recesses and said second and fourth recesses; and first and second adjustment pins respectively received in a first and second hole in said first and second cages, respectively, each of said pins having a face engaging said work rollers and moving said work rollers towards said third and fourth recesses.

12. The tool according to claim 11, wherein said tool holder is U-shaped with said legs at least partially defining said U-shaped.

13. The tool according to claim 12, wherein said legs are parallel.

14. The tool according to claim 12, wherein said legs are slightly movable relative to one another.

15. The tool according to claim 11, wherein said pins define said first and second recesses in pin faces.

16. The tool according to claim 11, wherein said pins are slidably received in said holes.

17. A deep rolling tool for rolling the grooves on crankshaft journals comprising:

a tool holder, a first cage supported on said tool holder and including a first recess;

a second cage opposite said first cage and including a second recess;

a work roller interposed between said cages and received by said recesses;

an adjustment pin received in a hole in said second cage, said pin having a face engaging said work roller and moving said work roller towards said first recess; and a screw received in said hole and adjacent to said pin, said screw manipulated to adjust said pin along an axis.

* * * * *

UNITED STATES PATENT AND TRADEMARK OFFICE

CERTIFICATE OF CORRECTION

PATENT NO. : 6,601,424 B2
DATED : August 5, 2003
INVENTOR(S) : Siegfried Baguscha It is certified that error appears in the above-identified patent and that said Letters Patent is hereby corrected as shown below:

Title page,
Item [54], Title, should read as follows:
-- [54] TOOL FOR DEEP ROLLING OF GROOVES ON CRANKSHAFT JOURNALS OR CRANK PINS --

Item [75], Inventors, should read as follows:
-- [75] Inventor: Siegfried Baguscha, Erkelenz (DE) --

Column 4,
Line 35, should read as follows: -- said U-shape. --

Signed and Sealed this

Twentieth Day of January, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,601,424 B2
DATED : August 5, 2003
INVENTOR(S) : Siegfried Bagusche It is certified that error appears in the above-identified patent and that said Letters Patent is hereby corrected as shown below:

Title page,
Item [75], Inventors, should read as follows:
-- [75] Inventor: Siegfried Bagusche, Erkelenz (DE) --

Signed and Sealed this

Thirteenth Day of April, 2004

JON W. DUDAS
*Acting Director of the United States Patent and Trademark Office*